US006067659A

United States Patent [19]

Reichle

[11] Patent Number: 6,067,659

[45] Date of Patent: May 30, 2000

[54] DEVICE FOR SORTING SOCKS

[76] Inventor: Wayne Reichle, 41 W. Main St. Apt. 1-F, Ayer, Mass. 01432

[21] Appl. No.: 09/364,719

[22] Filed: Jul. 30, 1999

[51] Int. Cl.[7] ..... A41F 1/00

[52] U.S. Cl. ..... 2/239; 24/704.1

[58] Field of Search ..... 2/239; 24/573.1, 24/108, 687, 662, 532, 542, 543, 559, 562, 561, 704.1

[56] References Cited

U.S. PATENT DOCUMENTS

| | | | |
|---|---|---|---|
| 1,198,567 | 9/1916 | Morley | 24/687 |
| 1,454,004 | 5/1923 | Weiss | 40/21 |
| 1,930,634 | 10/1933 | Weiss | 40/21 |
| 3,041,743 | 7/1962 | Monsma | 36/1 |
| 4,962,573 | 10/1990 | Breveglieri | 24/573.1 |
| 5,038,413 | 8/1991 | Ursino | 2/239 |
| 5,095,596 | 3/1992 | Dahood | 24/704.1 |
| 5,329,677 | 7/1994 | Kanzaka | 24/687 |
| 5,367,809 | 11/1994 | Ross | 40/668 |
| 5,467,510 | 11/1995 | Hartzell | 24/706.9 |

*Primary Examiner*—John J. Calvert
*Assistant Examiner*—Alissa L. Hoey
*Attorney, Agent, or Firm*—Kaplesh Kumar

[57] ABSTRACT

A sock sorting device comprising two clamping elements: the first having identifying indicia on its base and a plurality of solid posts extending therefrom, and the second having a corresponding plurality of internally hollow posts extending from a common base and each ending into sharp closed pointed ends. The interiors of the hollow posts comprise locking channels that are open at the base, extending through said base, and sealed at the closed pointed ends. In use, the solid posts can be received and permanently and fixedly secured in their corresponding locking channels using fastening means provided on the lateral surfaces of the solid posts and the lateral interior surfaces of the internally hollow posts. The device is attached to the sock by piercing the sock with the pointed end of the internally hollow post and achieving intimate contact of its base with the sock, clipping the excess length extending beyond the pierced sock to expose the locking channel at the pointed end, and penetrating the thusly exposed channel and receiving within it the solid post so that the sock is secured between the two fastened clamping elements.

25 Claims, 4 Drawing Sheets

FIG. 7(a)
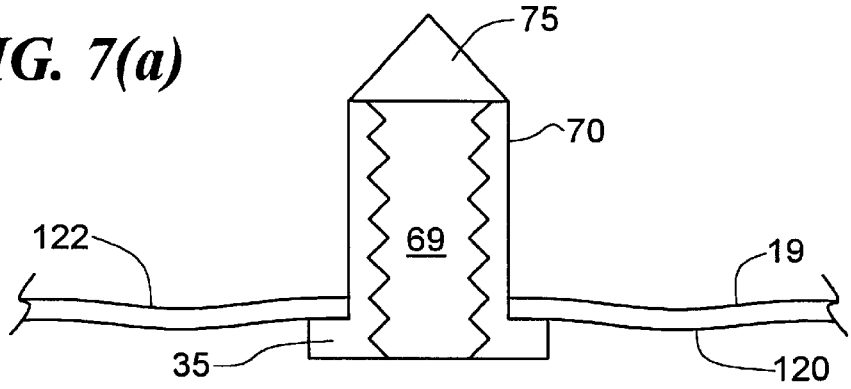
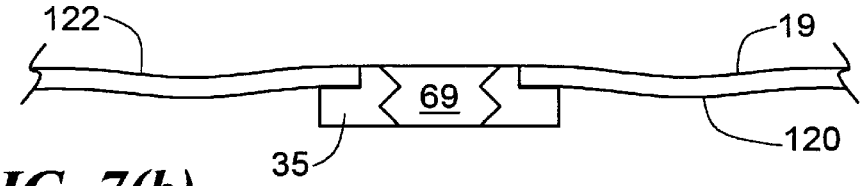
FIG. 7(b)
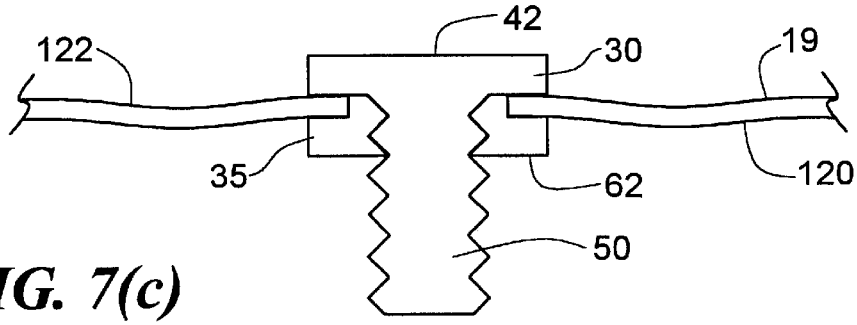
FIG. 7(c)
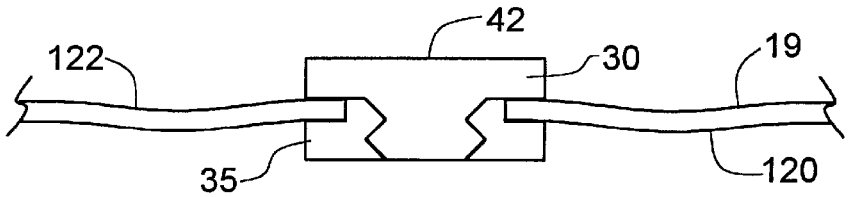
FIG. 7(d)

DEVICE FOR SORTING SOCKS

FIELD OF THE INVENTION

The present invention deals with devices and means for identifying and sorting pairs of socks belonging to members of a familial or communal unit.

BACKGROUND OF THE INVENTION

Means for tagging fabric and wear apparel for identification purposes have been developed for years. U.S. Pat. No. 1,930,634, dated Oct. 17, 1933 and issued to S. Weiss discloses a metallic piece that is attached to buttons or buttonholes for tagging fabrics. A more modern approach to tagging disclosed in U.S. Pat. No. 5,114,187, issued on May 19, 1992 to T. R. Branch employs a bar-coded ticket for attachment to laundry items, which is similarly attached to the selected article by threading and securing its adhesively attachable ends through buttonholes. The bar-code is scanned into a computer, which in turn controls a machine for selecting and sorting like items. By requiring holes through which the tag is fastened to the fabric or apparel, both these inventions avoid the need to staple the tags so that the operator does not get hurt or the fabric is not damaged when the tags are removed from the fabric after laundry and prior to usage.

Identifying socks belonging to specific pairs from a jumbled assortment of socks, such as after laundry within the familial unit, poses a significant challenge. Where the socks are made from similar fabric and are of dark and closely contrasting colors, it is particularly difficult to distinguish between them. With multiple members in the family unit, the difficulty increases because of the need to establish ownership of the socks, especially these days when socks are marketed in "one size fits all." The problem is compounded where there are more than one pair of socks of a given color. Unless means exists to identify socks constituting like pairs, the socks can be mismatched as to ownership, color, or original pairing. Usually, the mismatch is discovered when the wearer is in situations that can cause great embarrassment.

Various devices and means have been invented over the years to address sock sorting and matching. U.S. Pat. No. 2,785,413, issued Mar. 19, 1957 to T. K. Kook avoids the identification problem by fastening a plurality of pairs of socks along a single strip so that they stay together as pairs during laundry. Socks thus fastened can invariably break loose or, in the alternative, get wrapped about other laundry pieces, causing damage to delicate garments and great inconvenience to the operator in separating the laundry items after a washing or drying cycle. Means to fasten pairs of socks to each other during laundering are generally not preferred because of the potential for entanglements and damage to the attached fabric. Furthermore, because of the constricted access, it becomes very difficult for the socks to be cleaned in the regions where the fastening means are attached.

U.S. Pat. No. 4,734,938, issued Apr. 5, 1988 to B. R. Anderson teaches, as an alternative, means for identifying socks of given color and original pairing through the use of words and symbols knitted into a portion of the sock. The word, e.g. Blue, describes the color of the sock, and the symbol, e.g. square or triangle, identifies the socks comprising the original pair. Because the word or the symbol must be knitted into the fabric, this invention is beyond the individual consumer and must be implemented as part of the sock manufacturing process. It also does not provide the means to sort socks that are separated in color or design in only subtle ways. A similar approach to sock identification is described in U.S. Pat. No. 5,708,984, issued Jan. 20, 1998 to M. M. Shofner. The dominant color of the sock is identified by a symbol, numeral, or the distinctive color of a thread stitched or embroidered into a portion of the sock, such as the toe seam, that is covered by the shoe. This too places the burden on the sock manufacturing process and limits the options available to the consumer since he would need to track which socks of which design were bought by all members in the family to avoid confusion.

U.S. Pat. No. 5,367,809 dated Nov. 29, 1994 issued to E. B. Ross attaches single piece devices to socks by folding them over the edges of the socks thereby capturing within them portions of the sock walls as the devices snap shut with the male ends penetrating the sock walls and fastened to their other respectively adaptable female ends. The devices are provided in pairs with similar indicia comprising color, letter, or number for matching like pairs of socks. Device colors may be used to establish ownership. The device is limited in that it can only be applied at near the edge of the sock fabric thereby allowing only a minimum of material to prevent tear and damage from any pull on the device. The indicia disclosed provide limited identification ability, being unable to identify or differentiate between socks of different colors.

Devices that may be attached to any portions of the socks, capturing portions' of the sock walls between them, have been described in U.S. Pat. No. 5,357,635 issued Oct. 25, 1994 to R. E. Smith and U.S. Pat. No. 5,467,510 issued Nov. 21, 1995 to J. Hartzell. The Smith two-piece device attaches to the sock wall by capturing it between a rigid clamping element and one that is resilient. Because the device elements do not penetrate the sock wall they distort the sock wall at the point of attachment. Further, since the locking disc is resilient, it is likely that under the stress, turbulence, and heat circumstances encountered during repeated use, washing, and drying, the locking disc could distort and effect a release of the device. The disclosed invention limits the number of sock pairs that can be matched to twenty-five and provides no guidance to the owner of more than that number of sock pairs. A serious limitation of the disclosed device is that it makes no provision for variations in the sock wall thickness. Thus, while it may obtain adequate clamping for the designed sock wall thickness, it may be unable to be used with a sock wall thickness that deviates from it. The device numerical indicia are minimally disclosed and provide no means to establish ownership of the sock to which the device is attached.

Hartzell discloses a four-piece device that penetrates the sock wall and color codes the four pieces to facilitate identification of ownership as well as the color scheme of the sock by mixing the colors of the different pieces used in assembling the device' for tagging the sock. The use of four pieces complicates the device design and use. For example, 80 different pieces are required to tag ten pairs of socks. Where color differentiation is required, the number of pieces needs to be further increased to achieve the color scheme disclosed, which employs ten basic colors. This complicates the manufacturing and packaging requirements for the device, thus increasing its cost, and also places great demands on the consumer who has to use it. The frictional attachment means employed to keep the four pieces fastened together to the sock wall presents a serious limitation. The male piece pierces the sock wall and frictionally attaches to a second piece with a female opening on the other side, which captures the remaining two pieces on the other side of the sock wall. The frictional forces are likely to be overcome with usage resulting in the device separating from the sock.

SUMMARY OF THE INVENTION

Accordingly, an object of the present invention is to provide like pairs of low cost sock tagging devices with indicia stamped thereupon which can be used within the familial or communal unit for sorting and mating socks by ownership, color, or original match.

A second object of the present invention is to identify and sort laundered sock pairs without requiring the socks to be fastened to each other during the laundry cycle, thereby avoiding any entanglements or tear of the laundry items and facilitating proper cleaning of the socks.

Another object of the present invention is to permanently fasten the tagging devices to the socks by penetrating and capturing within the devices portions of the sock walls, avoiding their distortion, and achieving such attachment without using staples or requiring holes in the sock through which the fastening means are inserted and attached.

A further object of the present invention is to achieve a device with low parts count where the individual pieces are rigidly secured to each other by physical locking mechanisms substantially more reliable than fastening achieved through frictional forces alone.

Yet another object of the present invention is to achieve a tag applying means that does not depend on the sock manufacturing process but depends for its implementation on the individual consumer.

Another object of the present invention is to provide a device that has provisions for accommodating sock walls of different thickness.

These objects of the present invention are accomplished in the device set forth in the detailed description and claimed in this specification. Two-piece devices are provided in pairs with like indicia for attaching to the two socks comprising a mating pair. While the devices can be attached to any portions of the mating socks of any conventionally manufactured sock wall thickness, they will likely be fastened to the upper leg region of the socks where they will be hidden by the pants worn over them.

The device comprises a permanent attachment to the sock that is unobtrusive, color coordinated with the sock, and comfortable to the wearer. Permanent indicia, easily identifiable in a minimum of light and presented in a vivid contrasting color compared to its base, is provided in an inconspicuous, but readily accessible location. These indicia readily provide the sorter identification means as to ownership, color, and original match pairing of the socks. Sock sorting is achieved with the greatest ease and simplicity of use, and minimum demand on the user. The device of the present invention is provided for attaching to the socks after they have been purchased separately by the user.

BRIEF DESCRIPTION OF THE DRAWINGS

The device comprising the present invention will be more fully understood by considering the description set forth in this specification in conjunction with the drawings presented herewith.

FIG. 7 shows the several steps involved in practicing the present invention.

DETAILED DESCRIPTION

Figure 1:
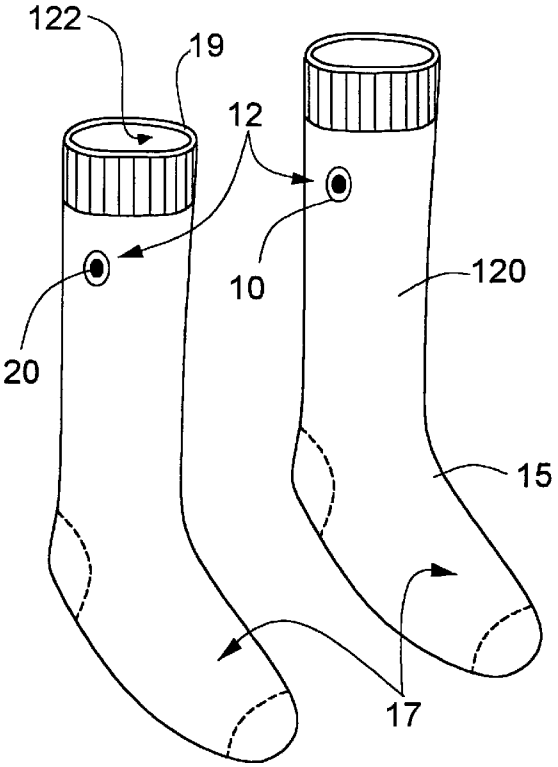
FIG. 1 presents a view of the invention as applied to a pair of socks.

The invention disclosed herein comprises a device 10 that is permanently and fixedly attached by a member of the household to the sock 15 as shown in FIG. 1. The device 10 is typically provided in pairs 12, wherein each device 10 possesses identical indicia 20 for identification purposes. The devices comprising pairs 12 are attached to mating pairs of socks 17 so that the socks belonging to individuals in the same household or communal unit can be sorted according to ownership, color and original match by matching the indicia 20 provided on the devices 10 comprising pair 12.

Figure 2:
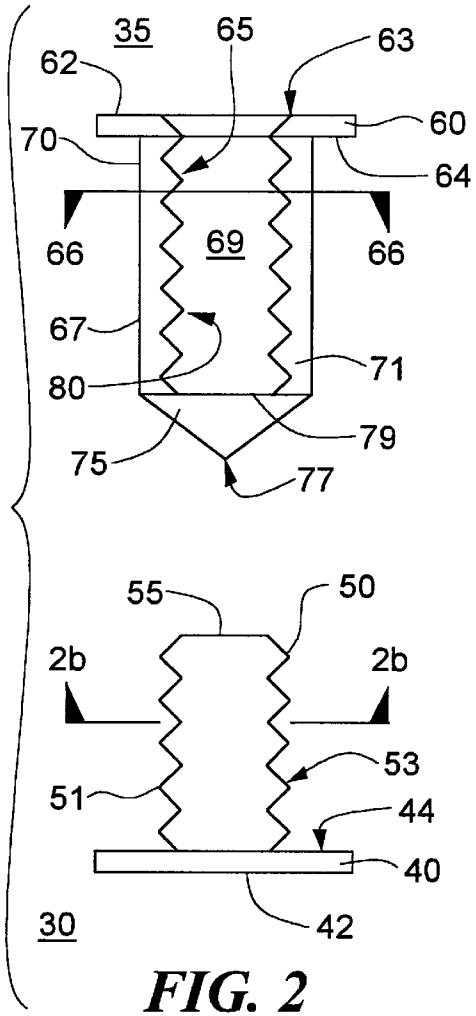
FIG. 2 shows the two principal elements of the device, the first and second clamping elements, which act together to practice the present invention.
Figure 2A:
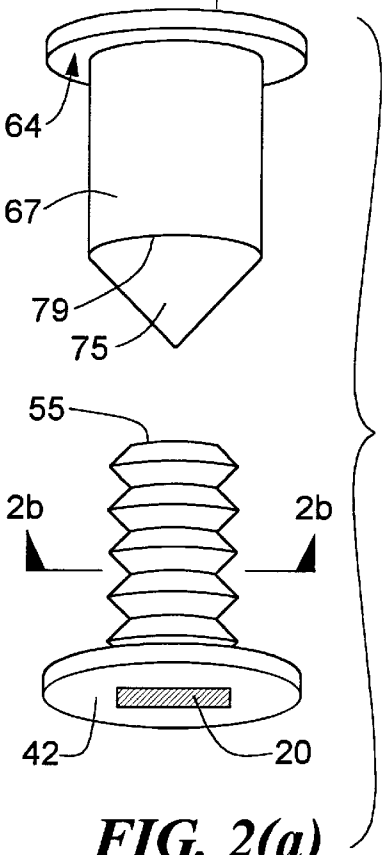
Figure 2B:
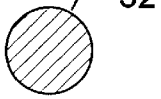

FIG. 2 shows the two principal elements of the device 10 comprising the present invention. The device 10 generally comprises a first clamping element 30 and a second clamping element 35.

Figure 3A:
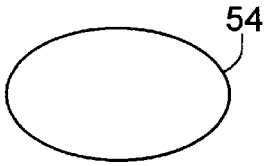
FIG. 3 shows three examples of cross sections that may be used for mating the extended portions of the first and second clamping elements so that one may be received within the other to accomplish the purposes of the present invention.
Figure 3B:
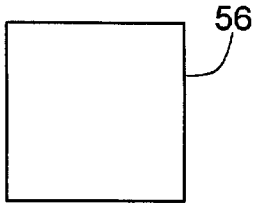
Figure 3C:
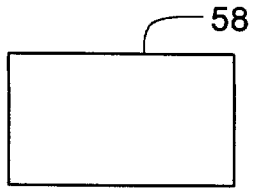

The first clamping element 30 consists of a base 40 having a first surface 42 and a second surface 44. The first surface 42 has indicia 20 stamped thereupon. The second surface 44 has a solid post 50 extending therefrom and terminating into a free end 55. The solid post 50 has a cross section 52 and a lateral exterior surface 51 on which fastening means 53 are provided. The cross section 52, which may be of any arbitrary selected shape, is preferably either circular 52 as in FIG. 2, elliptical or oval 54 as in FIG. 3(*a*), square 56 as in FIG. 3(*b*), or rectangular 58 as in FIG. 3(*c*). The base 40 is preferably an ovate or round disc with flat first 42 and second 44 surfaces that are also parallel to each other as seen in FIG. 2.

Figure 4B:
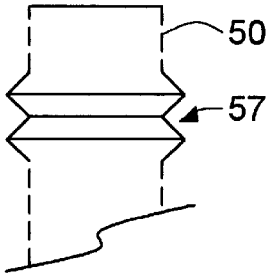
FIG. 4 shows ridges or grooves that may be provided on the first clamping element for fastening purposes.
Figure 4A:
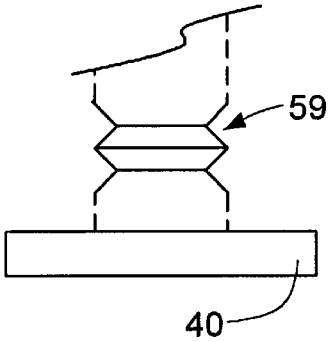

The fastening means 53 on the exterior lateral surface 51 preferably comprise grooves 59 or ridges 57 provided on the lateral surface 51 as shown in FIGS. 4(*a*) and 4(*b*) respectively. The grooves 59 or ridges 57, which are transverse to the length of the solid post 50 and enclose an area that is coaxially disposed with cross section 52, are provided along the length of the solid post 50. The grooves 59 and ridges 57 are preferably spaced equally with respect to each other along the length of solid post 50 and are preferably also angled towards the base 40 of the first clamping element 30.

In use, the second clamping element 35 is designed for permanently and fixedly attaching to first clamping element 30. The second clamping element 35 has a base 60 having a first surface 62 and a second surface 64. The first surface is defined by an outer perimeter 61 and an inner perimeter 63. The second surface 64 has an internally hollow post 70 extending therefrom that terminates into a solid pointed free end 75. The lateral interior surface 65 of the hollow post 70 extends from perimeter 63 to solid pointed end 75. The cross section 66 defined by the interior surface 65 of the internally hollow post 70 is coincident and coaxial with the cross sectional area enclosed by the inner perimeter 63. The hollow post 70 has an exterior surface 67 defining the second clamping element wall thickness 71.

Figure 5B:
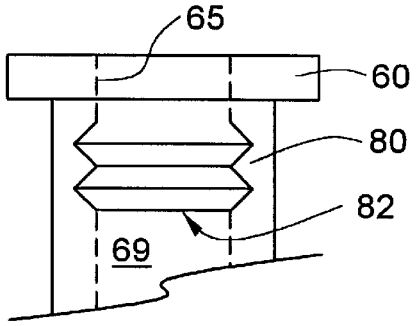
FIG. 5 shows similarly and complementarily constructed ridges and grooves on the second clamping element that provide means to couple with the fastening means of first clamping element so as to permanently and fixedly attach the two clamping elements together.
Figure 5A:
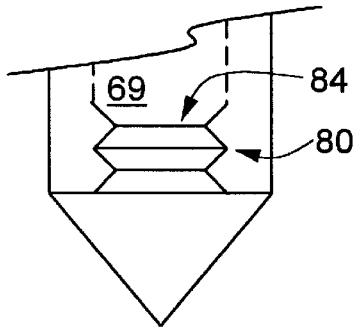

As shown in FIG. 5, the interior surface 65 encloses a locking channel 69 within which coupling means 80 are provided that fasten securely to fastening means 53 of first clamping element 30 when in use. Means 53 comprise grooves 59 or ridges 57. For accomplishing the purposes of the invention, the cross sections 52 of solid post 50 and 66 of internally hollow post 70 are similar to and compatible with each other, so that the solid post 50 may be received within the locking channel 69 from the normally closed pointed end of the second clamping element after exposing channel 69 by clipping away the solid end 75 and inserting solid post 50 into the thusly exposed channel 69. The internally hollow post is preferably an internally hollow cylinder with a circular cross section compatible with the solid post 50 which is also preferably cylindrical having a circular cross section 52.

While the solid pointed free end 75, which caps and seals the locking channel 69 of internally hollow post 70 may be of arbitrary geometry, it is preferably a solid cone with a sharp pointed vertex 77 and a circular base 79 coaxial and coincident with the preferred circular cross section of the exterior surface 67. The base 60 of the second clamping element 35 is preferably an ovate or round disc, whose first surface 62 and second surface 64 are preferably flat and parallel to each other. The coupling means 80 of the internally hollow post 70, shown in FIG. 5, preferably comprise grooves 82 or ridges 84 on interior surface 65 that are angled towards the base 60, and are respectively compatible with and mated to the grooves 59 or ridges 57 of solid post 50.

The first 30 and second 35 clamping elements, which may be made from a variety of materials, are preferably made of engineering thermoplastic materials using high speed injection molding processes known in the art. While the purposes of the invention may be accomplished with both clamping elements 30 and 35 made from like material such as Nylon, the first clamping element 30 is preferably made of a compliant thermoplastic and the second clamping element 35 of a more rigid thermoplastic. Alternatively, the first clamping element 30 could be made of a rigid plastic and the second clamping element 35 of a more compliant plastic.

Figure 6:
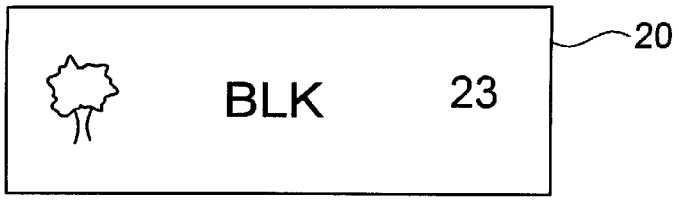
FIG. 6 shows an example of the indicia provided on the device for identifying socks with respect to ownership, color, and original match as to the pair.

While indicia 20 used for identifying mating sock pairs 17 to which identical devices are permanently and fixedly attached in pairs may be provided on either clamping element, they are preferably provided on the first surface 42 of the first clamping element 30. The indicia scheme claimed and practiced according to the present invention provides identification with respect to sock ownership, sock color, and sock mating to the original matched pair. Ownership is determined with a symbol, such as a golf club or a tree; the color is identified by an abbreviated descriptor such as BLK for the color Black; and mating to the original matched pair, thereby accommodating subtle variations in color scheme, is achieved by using a number, such as 01 or 99. FIG. 6 shows an example of indicia using these features, which are provided in identical pairs for practicing the present invention. Because indicia are always provided on the first clamping element, which the user may have appear on either the inside or the outside of the sock, information is readily obtained as to whether the sock has been worn with the right side exposed. The device is preferably attached with the first clamping element 30 bearing indicia 20 appearing on the inside of the sock so as to provide a smooth surface in contact with the skin of the wearer.

The two clamping elements 30 and 35 are preferably made so that the first clamping element 30, bearing indicia 20, is made in basic colors black, brown, red, blue and white, or in transparent plastic to closely resemble the color of the sock indicated in indicia 20. Distinctive indicia 20, easily identifiable in a minimum of light and presented in a vivid contrasting color compared to its base, is obtained on the surface 42 of first clamping element 30 in the as-molded condition or may be produced by processes such as hot stamping of the molded part 30. While the second clamping element 35 may also be made in colors matching those of the first clamping element, it is preferably made from transparent plastic, which offers the greatest degree of non-noticeability when the device is worn with the surface 62 of second clamping element 35 appearing on the outside of the sock.

In the preferred embodiment, the present invention is practiced according to the steps shown in FIG. 7. The free pointed end 75 of the internally hollow post 70 of the second clamping element 35, which is made of rigid plastic, is made to contact the exterior surface 120 of the sock wall 19 and the post 70 forced to penetrate the sock wall 19 by manually pushing on the first surface 62 of clamping element 35 as one would a thumbtack. The clamping element 35 comes to rest as its second surface 64 contacts the exterior surface 120 of the sock wall as shown in FIG. 7(*a*). The length of the internally hollow post 70 protruding beyond the interior surface 122 of the sock wall 19 is clipped close to the interior surface 122 of the sock wall 19 by the installer of the device with commonly available tools in all households such clippers or scissors. This removes the free end 75 and a portion of the internally hollow post 70 thereby exposing the locking channel 69 as in FIG. 7(*b*).

The free end 55 of the solid post 50 of the first clamping element 30 is then inserted into the exposed channel 69 as in FIG. 7(*c*). The first surface 62 of second clamping element 35 is supported so as to maintain intimate contact with the sock wall exterior surface 120 as the solid post 50 of the first clamping element 30 is pushed by applying finger pressure on its first surface 42 into the locking channel 69 at the clipped end of the second clamping element 35 as one would a thumbtack. The first clamping element 30 comes to rest when its second surface 44 contacts the interior surface 122 of the sock wall 19. The fastening means comprising the grooves 82 or ridges 84 of the second clamping element then permanently and fixedly attach to the coupling means comprising the grooves 59 and ridges 57 of the first clamping element to permanently and firmly fasten the device elements 30 and 35 to each other, trapping between them a portion of the sock wall 19. As shown in FIG. 7(*d*), the length of the solid post 50 protruding and extending beyond the first surface 62 of the second clamping element 35 is clipped by the installer of the device to present two smooth surfaces on either side of the sock wall, one of which, preferably the first surface 42 of first clamping element 30, contacts the user's skin when the sock is worn.

Although attachment of the two clamping elements can be achieved by providing a ridge in one element and a corresponding groove in the other, stronger and more permanent fastening is achieved by preferably providing for ridges on both clamping elements that are angled towards their respective bases. Thus, as the solid post of the first clamping element is inserted into the locking channel of the second clamping element, their respective ridges deform as they interfere with each other (the more compliant ridges deforming more than the rigid ones). This deformation is released as soon as the interference is overcome. Because of the opposed angled geometry of the ridges, the two clamping elements 30 and 35 are permanently and fixedly locked into place. Alternate fastening means may be similarly provided for rigidly securing the two clamping elements and are within the scope of the claimed invention.

Figure 8:
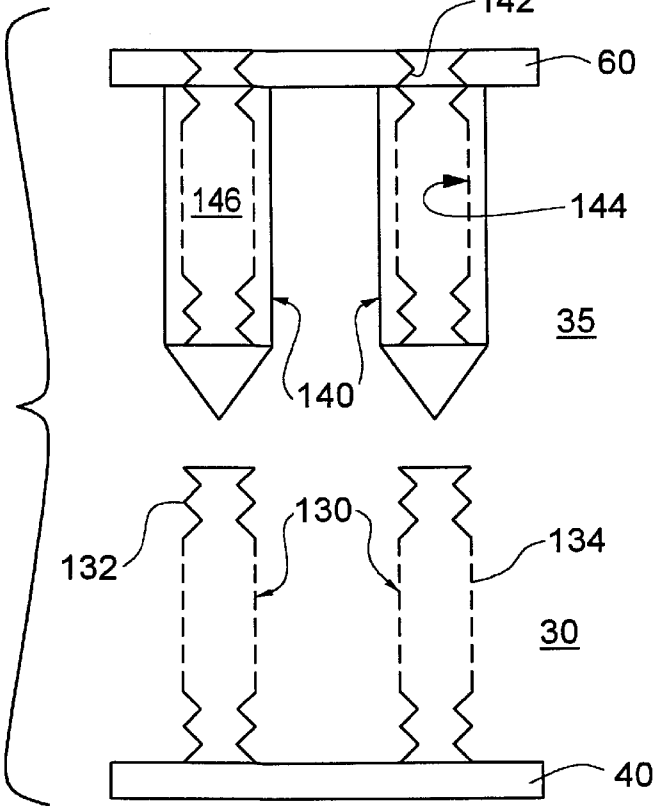
FIG. 8 presents a non-rotational embodiment of the present invention employing a plurality of extended mating portions of the two clamping elements comprising the present invention.

Because a single point fixed contact in the above embodiment of the present invention allows the device to freely rotate while in use, a second embodiment of the preferred invention shown in FIG. 8 uses a plurality of solid posts 130 on the base 40 of the first clamping element 30 and an equal corresponding plurality of mating internally hollow posts 140 on the base 60 of the second clamping element 35. Some or all of the mating pairs of solid posts 130 and internally hollow posts 140 are provided with similar fastening means 132 and 142 as herein described in FIGS. 4 and 5 on their respective external 134 and internal 144 surfaces. In the second embodiment of the preferred invention, the plurality of each of the solid 130 and hollow 140 posts is preferably two. The solid posts 130 and the hollow posts 140 are positioned respectively on the second surfaces 44 and 64 of bases 40 and 60 respectively, according to the same identical geometric pattern and spacing so that all the solid posts 130 are simultaneously inserted into their mating locking channels 146 of posts 140 for permanent non-rotational attachment of the device to the sock.

Figure 9B:
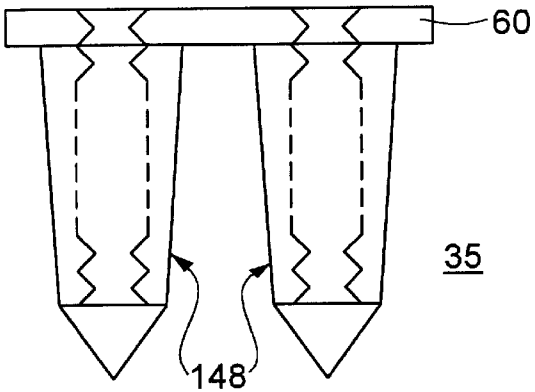
FIG. 9 represents a non-rotational embodiment of the present invention in which the external lateral surfaces of the extended mating portions of the two clamping elements are tapered so that they narrow from their base towards their free ends.
Figure 9A:
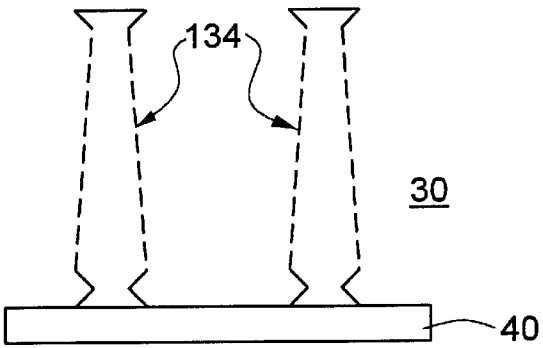

In yet a third embodiment of the preferred invention, for ease of insertion, the external surfaces 134 of the solid posts 130 of the first clamping element 30 may be tapered such that their areas of cross section 52 progressively decrease towards their free ends 55. See FIG. 9(*a*). Similarly, as in FIG. 9(*b*), tapered external surfaces 148 may also be provided for the internally hollow posts 140 of the second clamping element 35 such that they also progressively narrow from their base 60 to their free ends 75.

Other embodiments of the claimed invention, which would be apparent to those skilled in the art, are within its scope. The device comprising the present invention is to be limited only by the claims herein presented, and not by what has been particularly described in this specification.

I claim:

1. A sock sorting device comprising:

A first clamping element having a base with a first surface and a second surface, the first surface having identifying indicia thereon, the second surface having at least one solid post with a length extending therefrom, each solid post having fastening means deposited about a lateral surface thereof and terminating in a free end; a second clamping element having a base with a first surface and a second surface, said first surface defined by an outer perimeter and at least one inner perimeter, the second surface of the second clamping element having at least one internally hollow post with a length extending therefrom and terminating in a free pointed end, each pointed end capping and sealing a locking channel defined by an interior surface of each hollow post extending from the sealed end to the base, the locking channel further extending through the base and terminating at the inner perimeter which comprises the open end of the locking channels; cross sections of the mating solid posts and locking channels having such compatibilities as to receive at least one solid post within the corresponding locking channel, and the locking channel having coupling means for fixedly attaching to corresponding fastening means of the solid post; whereby the device is attached to the sock by piercing the sock with the pointed end of the internally hollow post and achieving intimate contact of its base with the sock, clipping excess length extending beyond the pierced sock to expose the locking channel at the pointed end, and penetrating the thusly exposed channel and receiving within it the solid post so that the sock is secured between the two fastened clamping elements.

2. A sock sorting device comprising:

A set of two identical first clamping elements, each having a base with a first surface and a second surface, the first surface having identifying indicia thereon, and the second surface having at least one solid post with a length extending therefrom, each solid post having fastening means disposed about a lateral surface thereof and terminating in a free end; a set of two identical second clamping elements, each having a base with a first surface and a second surface, the first surface defined by an outer perimeter and at least one inner perimeter, the second surface of the second clamping element having at least one internally hollow post with a length extending therefrom and terminating in a free pointed end; each pointed end capping and sealing a locking channel defined by an interior surface of each hollow post extending from the sealed end to the base, the locking channel further extending through the base and terminating at the inner perimeter which comprises the open end of the locking channel;

cross sections of mating solid posts and locking channels having such compatibilities as to receive at least one solid post within the corresponding locking channel, and the locking channel having coupling means for fixedly attaching to fastening means of the solid post.

3. The device of claim 1 wherein the first and second surfaces of first clamping element base are flat and parallel to each other, and said base is a disc.

4. The device of claim 3 wherein extending solid posts have circular cross sections and are normal to said base.

5. The device of claim 1 wherein the first and surfaces of the second clamping element base are flat and parallel to each other, and said base is a disc.

6. The device of claim 5 wherein the extending internally hollow posts have circular cross sections and are normal to said base.

7. The device of claim 1 wherein the first and second clamping elements are made of thermoplastic materials.

8. The device of claim 7 wherein the first clamping element is more compliant than the second clamping element.

9. The device of claim 7 wherein the second clamping element is more compliant than the first clamping element.

10. The device of claim 1 wherein the first and second clamping elements are made by injection molding.

11. The device of claim 1 wherein identifying indicia are produced by hot stamping.

12. The device of claim 1 wherein the first and second clamping elements are made of nylon.

13. The device of claim 1 wherein the bases of the first and second clamping elements are discs, the solid posts are right circular cylinders, the internally hollow posts are right circular internally hollow cylinders, and the pointed ends comprise solid cones capping and sealing the internally hollow cylinders.

14. The device of claim 1 wherein the solid posts are tapered so that they narrow with their cross sections decreasing from the base to the free ends.

15. The device of claim 1 wherein fastening means include a plurality of continuous or discrete ridges or grooves disposed circularly on lateral surfaces of the solid posts along lengths thereof.

16. The device of claim 15 wherein the ridges or grooves are angled towards the base of the first clamping element.

17. The device of claim 1 wherein coupling means include a plurality of continuous or discrete ridges or grooves disposed circularly on the interior surfaces defining the locking channels along the lengths of the internally hollow posts.

18. The device of claim 17 wherein the ridges or grooves are angled towards the base of the second clamping element.

19. The device of claim 13 wherein the outer perimeter is a circle and the inner perimeters are also circles.

20. The device of claim 1 wherein said solid posts have a square cross section, and the interior surfaces of the internally hollow posts have compatible square cross sections.

21. The device of claim 1 wherein the internally hollow cylinders are tapered so that they narrow from the base of the second clamping elements to the pointed ends.

22. The device of claim 1 wherein the plurality of the solid posts, inner perimeters, and internally hollow posts is two.

23. The device of claim 2 wherein the plurality of the solid posts, inner perimeters, and internally hollow posts is two.

24. The device of claim 1 wherein said identifying indicia comprise a combination of a symbol, a color, and a number.

25. The device of claim 2 wherein said identifying indicia comprise a combination of a symbol, a color, and a number.

* * * * *